United States Patent [19]

Wallace

[11] 3,950,579

[45] Apr. 13, 1976

[54] METHOD OF COATING SURFACE

[75] Inventor: Richard B. Wallace, Bloomfield Hills, Mich.

[73] Assignee: The Oakland Corporation, Troy, Mich.

[22] Filed: Mar. 15, 1974

[21] Appl. No.: 451,442

[52] U.S. Cl. ..... 427/379; 427/385; 427/409; 427/414; 427/420; 427/435

[51] Int. Cl.[2] ..... B05D 1/38

[58] Field of Search ..... 117/72, 81, 113, 105.3, 117/75, 94; 151/14.5; 85/1 C; 427/379, 385, 409, 414, 420, 435

[56] References Cited

UNITED STATES PATENTS

| | | | |
|---|---|---|---|
| 3,022,197 | 2/1962 | Jedlicka | 428/447 |
| 3,282,729 | 11/1966 | Richardson et al. | 117/72 X |
| 3,468,099 | 9/1969 | Vogt | 117/105.3 X |
| 3,508,947 | 4/1970 | Hughes | 117/105.3 X |
| 3,524,756 | 8/1970 | Signorino | 117/72 |
| 3,637,418 | 1/1972 | Dotson et al. | 117/81 X |
| 3,676,191 | 7/1972 | Bond | 117/72 X |
| 3,819,405 | 6/1974 | Engle | 117/138.8 UA |
| 3,826,673 | 7/1974 | Batson et al. | 117/94 X |

*Primary Examiner*—Ralph Husack
*Attorney, Agent, or Firm*—Whittemore, Hulbert & Belknap

[57] ABSTRACT

The method of forming relatively thick deposits of polymeric material on a surface of small threaded articles which comprises forming a thin coating on the surface of a solution of the polymeric material, at least partly drying the coating to eliminate some or all of the solvent for the polymeric material, applying a barrier coating to the polymeric material to protect it from attack by solvent, and applying a second thin coating of a solution of the polymeric material. The operation may be repeated as necessary to build up the required thickness of deposit. Coating is by successive immersions in baths of the polymeric solution separated by immersion in baths of the barrier material, or by other bulk treatment therewith, followed by partial drying before subsequent immersions and final drying after the last immersion.

21 Claims, 2 Drawing Figures

METHOD OF COATING SURFACE

DETAILED DESCRIPTION

Figure 1:
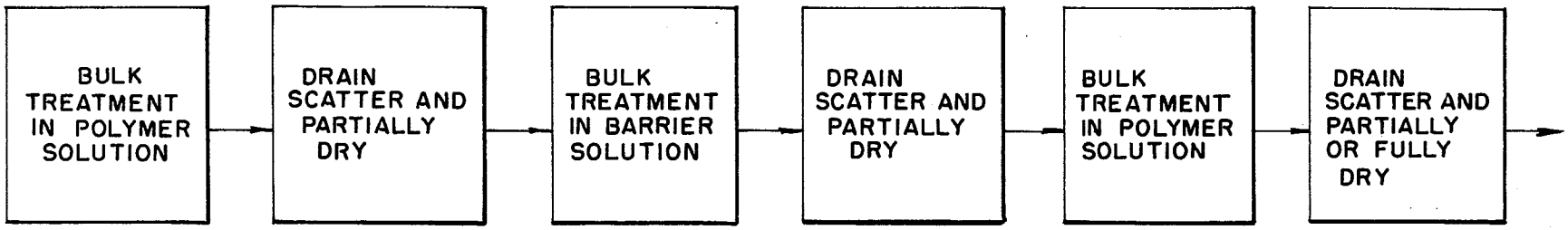
FIG. 1 is a block diagram indicating the successive steps which constitute the method.

The present invention in its broadest aspect relates to providing relatively thick deposits or coatings of polymeric material on a surface of a thickness too great to be formed satisfactorily in a single step.

A particularly useful application of the present invention is in the application of a selected polymeric material to a threaded article, to form a deposit on the threaded portion which provides a frictional resistance to turning of the treated article relative to a mating threaded part, and which in addition may provide a sealing action. Articles of this type are disclosed in prior copending application of Wallace et al, Ser. No. 383,059, filed July 27, 1973, U.S. Pat. No. 3,893,496.

As disclosed in the above identified Wallace application, the resinous polymeric material may be a polyurethane including a relatively small percentage of a silicone resin for the purpose of promoting adhesion between the resinous mixture and the surface of the threads. However, it has been found that greatly superior results are obtained when the basic resin is essentially acrylic in nature, and the adhesion promoting addition may be either a polyamide or a silicone.

The invention as described in the foregoing relates to the application to the threads of a threaded member of acrylic or methacrylic polymers, specifically resins, and an organopolysiloxane, specifically a silicone resin or a polyamide resin having active amine end groups. The acrylic and methacrylic polymers are made by the polymerization of the acrylic and methacrylic monomers.

Two general types of monomers are available for the production of acrylic resins. These are the acrylate monomers and the methacrylate monomers. For convenience, polymers produced from both types are usually referred to as acrylic polymers. The basic formula is:

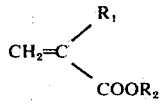

where $R_1$ is hydrogen or a methyl group and $R_2$ is an aliphatic group, such as an alkyl group or hydrogen.

For the purposes of the present invention it has been found that the degree of hardness of the acrylic and/or methacrylic polymers most suitable and useful is achieved when $R_2$ is an alkyl group selected from the group consisting of methyl to lauryl inclusive. Thus, $R_2$ can be a methyl group, an ethyl group, a propyl or isopropyl group, a butyl or isobutyl group, a pentyl, isopentyl or neopentyl, a hexyl or any of the isomeric hexyl groups, a heptyl or any of the isomeric heptyl groups, an octyl or any of the isomeric octyl groups, a nonyl or any of the isomeric nonyl groups, a decyl or any of the isomeric decyl groups, an undecyl or any of the isomeric undecyl groups, and a lauryl or any of the isomeric lauryl groups.

It has been found tha the alkyl groups larger than the lauryl group or its isomers will produce a coating which is quite soft and has a rather tacky surface, and although this coating will still work to produce a self-locking threaded member, it will not produce a coating with the optimum desired characteristics.

The aforedescribed acrylic and methacrylic polymers to which the silicone or polyamide resin is added, are dissolved in an appropriate organic solvent such as propylene oxide, methyl-ethyl-ketone, toluene, acetone, benzene, trichloroethane, and the like. The liquid polymer-solvent mixture is then applied to the threads of the threaded member.

When the solvent is driven off there remains a deposit of the acrylic, methacrylic, or a mixture of the acrylic and methacrylic polymer together with the silicone or polyamide resin. This deposit adheres to the threads and has a non-tacky outer surface. It has been found that this deposit has the unusual property of having its internal cohesive strength exceeded by its external surface adhesion to the metal of the coated threaded member, and by the frictional forces developed between its non-tacky outer surface and the metal of the mating nut. Thus, upon the application of a predetermined torque internal shear or separation between the material takes place and the material exhibits internal flow. Upon cessation of the external torque the material re-establishes itself. While this internal separation and flow of the material occurs the adhesive bond between the material and the treated threaded member and the frictional bond between the non-tacky outer surface of the material and the mating nut or other threaded member remain intact and are not broken.

It is also possible to vary the properties of the polymeric coating by, in addition to varying the substituent $R_2$ groups, mixing two or more acrylic polymers, each of which has a different $R_2$ group, or by mixing a methacrylic polymer with an acrylic polymer. Thus, for example, a coating having the optimum combination of an external adhesive bond and a non-tacky surface, as well as having an internal cohesive force which is less than the external adhesive and frictional bonds and thus having a correspondingly high degree of internal flow or a low shear point, is produced when a hard polymethyl methacrylate, where $R_2$ is a methyl group, is mixed with a soft polymethyl acrylate, where the $R_2$ group is a lauryl group.

Although the adhesion of the acrylic and/or methacrylic polymer coating to the surface of the treated member is sufficient for most purposes, it is usually desirable to increase this adhesive bond. This is accomplished by adding an organopolysiloxane resin to the acrylic and/or methacrylic polymer.

The organopolysiloxane resins are materials having the general structural formula:

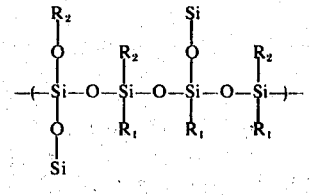

where $R_1$ and $R_2$ are methyl, ethyl and phenyl groups, and there is cross-linkage between the silicon atoms of one chain and the silicon atoms of another chain.

It has been found that a silicon resin wherein $R_1$ and $R_2$ are methyl and phenyl groups is quite effective in increasing the adhesion of the silicone resin - acrylic composite coating to the threads of the coated member.

In preparing this silicon resin - acrylic composite the silicone resin, such as a methyl phenyl silicone resin, is added in an amount of from about 5% to about 15%, and preferably about 10%, by weight to a solution of the acrylic and/or methacrylic polymer dissolved in a solvent. The resulting mixture is then applied to a threaded member and the solvent is evaporated.

Instead of a suitable silicone resin, a polyamide, more specifically a polyamide resin, with active amine end groups is added to the acrylic. The polyamide resins having active amine end groups are produced by the reaction of a polybasic acid, preferably a dibasic acid, and an excess of a polyamine, preferably a diamine. The carboxylic dibasic acids have two hydrogen atoms capable of replacement by basic atoms or radicals and have the general formula:

$$HOOC - R - COOH$$

where R is a hydrocarbon group. The diamines used in this embodiment of the invention have the general formula:

$$H_2N - R' - H_2N$$

where R' is a hydrocarbon group. The polyamide resins containing active amine end groups which are produced by this reaction of a dibasic carboxylic acid and a diamine have the general structural formula:

$$H_2N-R' - HN(-OC - R - CONH - R' - NH -)_n H$$

where R is the hydrocarbon group of the dibasic carboxylic acid and R' is the hydrocarbon group of the amine.

Some representative examples of the dibasic carboxylic acid which can be used to produce the polyamide resin with active amine end groups are adipic acid, dimerized linoleic acid.

Some representative examples of the diamines which can be used to produce the polyamide resin with active amine end groups are ethylene diamine, trimethylenediamine, tetramethylenediamine, pentamethylenediamine, hexamethylenediamine, metaphenylene diamine, and 4,4'' methylene dianiline.

In one example dimerized linoleic acid was reacted with an excess of ethylene diamine to produce a polyamide having active amine end groups and having the general structural formula:

$$H_2N - CH_2CH_2 - HN(-OC - R - CONH - CH_2CH_2 - NH -)_n H$$

where R is a hydrocarbon group of an indeterminate configuration containing 34 carbon atoms.

The linear polyamide with active amine end groups is added to the acrylic in an amount sufficient to form a mixture, once the solvent is driven off, of from about 2 to about 24% polyamide and from about 98 to about 75% acrylic. The preferred concentration of the polyamide is from about 10% to about 15% of the mixture.

In the practice of the present invention the polyamide is added to a solution comprising an acrylic polymer dissolved in a suitable solvent such as trichloroethane or methyl-ethyl-ketone. Upon addition of the polyamide to the acrylic polymer a complex formation process occurs between the polyamide polymer and the acrylic polymer. This process is not the usual type of cross-linking process wherein primary carbon bonds are formed but rather involves the formation of secondary hydrogen bonds. The secondary hydrogen bonds are formed by the attraction between the acid groups of the acrylic polymer $-COO(H^+)-$ and the active amine groups of the polyamide polymer $(-NH_2^-)$. This secondary hydrogen bonding produces complexes which are much weaker than the cross-links ordinarily formed by the primary bonds.

In the past, successful application of a deposit of polymeric material to a multiplicity of threaded articles usually has required individual treatment of the articles, and efforts to treat a mass of articles in bulk have failed. The polymeric has to be applied in solution, after which the solvent is evaporated. Where a quantity of threaded articles, such as set screws, was immersed in a solution of a consistency or viscosity such as to provide a deposit of the required thickness or amount of solution, and hence the required amount of polymeric material as a resultant deposit after drying, the articles stuck together in an agglomerated mass and did not produce a uniform deposit of polymeric material in the thread grooves of the articles. Efforts to produce the required amount of polymeric material in the thread grooves by repeated immersion in thinner solutions failed because the solvent in successive baths attacked or dissolved the polymeric material deposited in previous immersions.

In accordance with the present invention, these difficulties have been overcome by repeated immersions in solutions of polymer having a thickness or viscosity such that a thinner than required deposit of polymer is provided at each immersion. The previous deposit of polymer is protected in a subsequent immersion by providing a barrier coating over the surface of the prior deposit. The screws or similar articles may be immersed in screen baskets dipped into a tank of polymer solution, the basket removed to a position above the tank where excess solution drains back into the tank, and the screws then scattered onto a moving conveyor where some or all of the solvent is evaporated. This may be accomplished by heating the screws, by blowing warm dry air over them as they advance, or both.

The conveyor advances the initially coated screws to a second tank containing a solution or suspension of a material which is referred to herein as a barrier material, since its function is to form a barrier on the surface of the previous deposit of polymer which protects it from attack or partial attack by the solvent.

The barrier coated articles are then again scattered on an advancing conveyor, and dried by evaporation of the carrier or solvent for the barrier material sufficiently for a second immersion in the polymer solution to build up the thickness of deposit of the polymer to or toward its required degree.

Conveniently, the conveyors may be arranged to feed the articles to the tanks of barrier coating material or polymer solution, where they may drop off the conveyors into screen baskets to facilitate removal of a quantity of articles in bulk for scattering onto advancing conveyors for drying by evaporation of the solvent or suspension material.

With this arrangement only two tanks are required, one for polymer solution, and one for the barrier material. The articles may be immersed as many times as required in the polymer solution to build up the required deposit, so long as they are immersed in the barrier bath between successive immersions in the polymer solution.

The articles do not require individual handling, the only requirement being that they are scattered on the advancing conveyors.

The practice of the invention is of course not limited to any particular materials, the only requirement being that the barrier material be capable of protecting the dry or partially dried deposit of polymer from attack by the polymer solvent during subsequent immersion.

Obviously, the amount of polymer deposited on each immersion is dependent on the thickness or viscosity of the polymer solution, and any convenient number of successive immersions can be scheduled.

In general, the barrier coating will be as thin as possible while still serving its barrier function. It is found that the provision of the barrier coating does not significantly prevent evaporation of remaining polymer solvent from beneath the barrier coatings, either in intermediate drying steps or in final elimination of polymer solvent after the final immersion treatment. It has also been found that retention of the barrier material in the multiple layer deposit of polymer does not interfere with functioning of the polymer, and any additives included therein, as a friction thread lock, a sealant, or both.

FIG. 1 is a block diagram indicating the successive steps which constitute the method. The first step, described as "bulk treatment in polymer solution" presupposes preparation of the polymer solution at a consistency which will result in producing a deposit of the polymer less in amount than desired. The bulk quantity of articles may conveniently be placed in a screen container or basket which is then lowered into a tank containing the solution and preferably agitated to ensure uniform application of the solution to each of the articles.

The second step, described as "drain, scatter and partially dry" is accomplished by raising the screen container or basket to a position above the polymer solution and permitting excess solution to drain back into the tank. The scattering of the articles is conveniently accomplished by pouring the articles onto an advancing belt at a rate such that in general the individual articles are separated from each other. Radiant heat, or dry heated air, or both, is directed onto the belt to effect a quick partial drying by evaporation of the solvent. It is not necessary to fully dry the polymer since final drying may be completed after the final immersion in the barrier solution. If desired, the conveyor may be in the form of a belt, and the articles may be moved slightly on the belt as they advance to expose all surfaces of the articles to uniform drying action. For example, the belt may advance beneath a multiplicity of fingers extending close to the belt, and are widely separated both laterally and longitudinally of the belt to displace articles laterally of the belt as they advance.

The drying action should be continued until the surface of the deposited material has become essentially non-tacky. The initial quick drying forms a "skin" which is non-tacky while the material beneath the skin may remain quite fluid.

The third step is described as "bulk treatment in barrier solution". This may conveniently be carried out simply by letting the conveyor discharge the articles into a screen container or basket which is positioned within the solution or suspension of barrier material. Alternatively of course, the articles may be discharged into a container or basket separate from the tank containing the barrier bath, after which the container of articles is immersed and preferably agitated to ensure uniform treatment of all articles. This permits accurate control of the time throughout which the articles are subjected to the barrier treatment.

The fourth step is described as "drain, scatter and partially dry" and may be identical with the second step except that the effectiveness of the drying action will be controlled so that the coating of barrier material is rendered effective to serve its intended purpose.

The fifth step is described as "bulk treatment in polymer solution" and may be identical with the first step, except that it is desirable to time the application of polymer solvent uniformly to all articles. The barrier material acts to prevent re-dissolving of previously applied polymeric material at the surface thereof, and prolonged immersion in the solution may be undesirable. For this reason it is preferable to collect the partly dried articles after immersion in barrier solution or suspension separately from the tank of polymer solution, and to immerse the entire lot simultaneously, and preferably to agitate the screen container or basket sufficiently to ensure uniform treatment of all articles.

The sixth step is described as "drain, scatter, and partially or fully dry". Where three or more applications of polymer are required, this step may be identical with the second step. However, where the previous immersion in the polymer solution is the last application of polymer, the drying operation may be initiated on a belt and carried to a point where the last layer of polymer has acquired a "skin" sufficiently non-tacky to permit bulk storage of articles without causing them to stick together. At this time substantial solvent may remain within the interior of the polymeric deposit, but it will continue to evaporate until the polymer becomes substantially uniform in consistency throughout.

Figure 2:
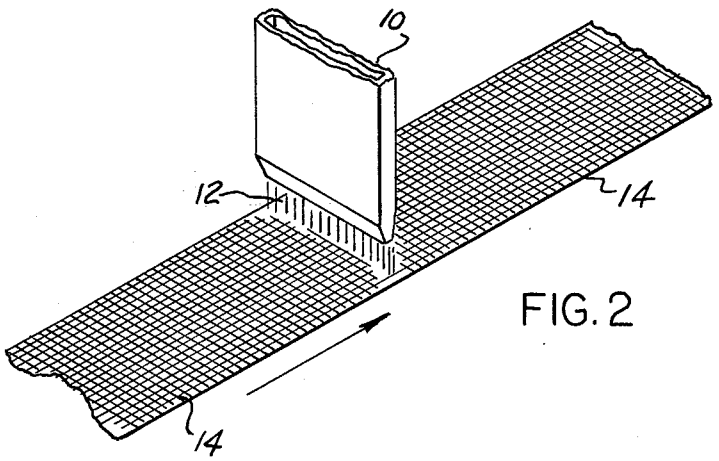
FIG. 2 is a fragmentary diagrammatic showing of a bulk treatment apparatus.

Instead of actually immersing the articles in a bath, the application of polymer or barrier material may be by advancing the articles, as for example on a screen conveyor, beneath an elongated nozzle extending transversely of the conveyor to provide a continuous sheet of curtain of liquid through which the articles advance and are as fully coated as if actually immersed in a bath. Such an arrangement is diagrammatically shown in FIG. 2, where nozzle 10 provides a continuous curtain or sheet of polymer solution or barrier material as seen at 12 onto articles advanced in the direction of the arrow on screen conveyor 14. This has the advantage that the coated articles are promptly drained, and drying is initiated by heat and/or drying air.

SPECIFIC EXAMPLES

In a preferred practice of the present invention, a deposit of acrylic polymer is to be applied to small set screws. The acrylic polymer or polymers may be as disclosed in the prior copending application of Wallace et al, Ser. No. 383,059, with or without additives as disclosed therein, and is dissolved in one of the organic solvents disclosed therein. A preferred solvent is methyl-ethyl-ketone (MEK) and the solution is prepared to have a thickness or viscosity selected to produce a deposit of the polymer of less than the final required amount.

The barrier material is polyvinyl alcohol (PVA) and may be provided in a water solution of 3–4% PVA by weight.

Excellent results have been obtained from two bulk treatments in the polymer solution with an interposed bulk treatment in the barrier solution.

A second specific example of the method of building up a required deposit of polymer by repeated immersions employs an acrylic polymer or a mixture of acrylic polymers, with or without additives as disclosed in the aforesaid prior application, dissolved in MEK. In this example however, the barrier material is ordinary animal gelatin in a water solution with the gelatin about 20% by weight.

In somewhat more general terms the barrier agent may be any material capable of forming a film deposit or coating over the surface of a previously applied partially dried polymer solution to protect the polymer from re-dissolving by action of the polymer solvent in a successive immersion. While specific examples refer to the approximate percentages, it will be understood that the percentage by weight of the barrier agent in the liquid carrier may vary for different applications. For example, the polyvinyl alcohol, which in the specific example constituted about 3–4% by weight in a water solution, may be as little as 1 or 2%, and the percentage of polyvinyl alcohol by weight may be very substantially higher. However, the 3–4% by weight mentioned in the specific example represents a satisfactory solution, and increasing the percentage of polyvinyl alcohol would be uneconomical. Accordingly, in more general terms, the polyvinyl alcohol solution may contain polyvinyl alcohol from a minimum effective amount (1 or 2%) up to about 10% without serious loss of economy.

What I claim as my invention is:

1. The method of building up a deposit of predetermined thickness of a friction producing resinous organic polymer on the thread surface of a threaded article which comprises preparing a solution of the polymer in a volatile organic solvent of a consistency such that application of an excess of the solution, draining and subsequent drying will provide a deposit of less than said predetermined thickness, applying an excess of the solution to the thread surface, draining the excess solution from the article, partly drying the deposit by evaporation of solvent to produce a substantially non-tacky outer surface on the partly dried deposit of polymer, applying a mixture of a barrier material in water to the surface of the partly dried deposit of polymer, partly drying the mixture to leave a coating of barrier material having a thickness only sufficient to protect the previous deposit of polymer from re-dissolving in the solvent, again applying an excess of the solution to the article, draining the excess solution from the article, and at least partly drying the last deposit by evaporation of solvent to produce a substantially non-tacky outer surface on the last deposit of polymer.

2. The method of claim 1 in which the polymer is essentially acrylic.

3. The method of claim 2 in which the solvent is methyl-ethyl-ketone.

4. The method of claim 3 in which the mixture is polyvinyl alcohol in a water solution.

5. The method of claim 1 in which the mixture is gelatin in a water solution.

6. The method of claim 1 in which the mixture is polyvinyl alcohol in a water solution.

7. The method of simultaneously building up a deposit of predetermined thickness of a friction producing resinous organic polymer on the surface of a multiplicity of small threaded articles which comprises preparing a solution of the polymer in a volatile organic solvent of a consistency such that application of an excess of the solution, draining, and subsequent drying will provide a deposit of polymer of less than said predetermined thickness, substantially simultaneously applying an excess of the solution to a multiplicity of such articles, draining the excess solution from the articles, supporting the articles in separated condition from each other, substantially simultaneously applying to the articles an excess of a mixture of barrier forming material in water, draining excess mixture therefrom, drying the mixture applied to the articles to leave a barrier coating of barrier material of a thickness only sufficient to protect the previous deposit of polymer from re-dissolving in organic solvent, again substantially simultaneously applying an excess of the solution to the multiplicity of articles, draining excess solution, separating the articles from each other, and drying the articles to provide a non-tacky outer surface.

8. The method as defined in claim 7 in which the application of the excess of solution to the articles is accomplished simultaneously for all articles making up the said multiplicity by immersing the multiplicity of articles in the solution.

9. The method as defined in claim 8 in which the steps of immersion, and draining are accomplished by placing the multiplicity of articles in a screen basket having openings through which solution and the mixture can drain, immersing the basket with the articles therein alternately in baths of the solution and the mixture, lifting the baskets above the baths, and permitting drainage through the openings back into the respective baths.

10. The method as defined in claim 7 in which the polymer comprises a major proportion of acrylic resin.

11. The method as defined in claim 10 in which the solvent is essentially methyl-ethyl-ketone.

12. The method as defined in claim 7 in which the mixture is animal gelatin or polyvinyl alcohol in a water solution.

13. The method as defined in claim 7 in which the mixture is a solution of about 20% animal gelatin in water.

14. The method as defined in claim 7 in which the mixture is a solution of polyvinyl alcohol in water with the polyvinyl alcohol provided in an effective amount up to 10% by weight of the solution.

15. The method as defined in claim 7 in which the mixture is a solution of polyvinyl alcohol in water with the polyvinyl alcohol provided in an amount of 3–4% by weight of the solution.

16. The method as defined in claim 7 in which the steps of applying the excesses of the solution comprise advancing the articles on a screen conveyor, and providing a continuous falling curtain of the solution to extend across the conveyor through which the articles advance.

17. The method as defined in claim 16 in which the polymer is essentially acrylic.

18. The method as defined in claim 17 in which the solvent is methyl-ethyl-ketone.

19. The method as defined in claim 18 in which the mixture is polyvinyl alcohol in a water solution.

20. The method as defined in claim 16 in which the mixture is gelatin in a water solution.

21. The method as defined in claim 16 in which the mixture is polyvinyl alcohol in a water solution.

* * * * *